US005880659A

United States Patent [19]

Woods

[11] Patent Number: 5,880,659

[45] Date of Patent: Mar. 9, 1999

[54] MAGNETIC SWITCH ASSEMBLY FOR DETECTING UNAUTHORIZED OPENING OF DOORS OR WINDOWS

[76] Inventor: Randell Woods, 230 Longbranch East, Prescott, Ariz. 86303

[21] Appl. No.: 819,150

[22] Filed: Mar. 17, 1997

[51] Int. Cl.[6] ..... H01H 9/00

[52] U.S. Cl. ..... 335/207; 200/61.7; 340/547

[58] Field of Search ..... 335/205–7; 340/545, 340/547, 542, 686–687; 200/61.45 R, 61.45 M, 61.7–73

[56] References Cited

U.S. PATENT DOCUMENTS

| | | | |
|---|---|---|---|
| 1,051,962 | 2/1913 | Lundquist . | |
| 1,192,893 | 8/1916 | Harvey . | |
| 1,868,923 | 7/1932 | Semon . | |
| 3,516,036 | 6/1970 | Lea . | |
| 3,535,664 | 10/1970 | Staar . | |
| 3,630,168 | 12/1971 | Fladlay . | |
| 3,650,347 | 3/1972 | Campos . | |
| 3,763,484 | 10/1973 | Byers . | |
| 3,816,680 | 6/1974 | Suzuki et al. . | |
| 3,842,377 | 10/1974 | Barndt . | |
| 4,042,796 | 8/1977 | Zink . | |
| 4,057,773 | 11/1977 | Cohen . | |
| 4,062,314 | 12/1977 | Allen et al. . | |
| 4,168,410 | 9/1979 | Norris . | |
| 4,210,888 | 7/1980 | Holce et al. | 335/207 |
| 4,275,391 | 6/1981 | Okamura . | |
| 4,293,860 | 10/1981 | Iwata . | |
| 4,326,196 | 4/1982 | Plevy . | |
| 4,336,518 | 6/1982 | Holce et al. . | |
| 4,450,326 | 5/1984 | Ledger . | |
| 4,456,897 | 6/1984 | Holce et al. . | |
| 4,553,134 | 11/1985 | Holt . | |
| 4,567,846 | 2/1986 | Kurtz . | |
| 4,628,160 | 12/1986 | Canevari . | |
| 4,656,458 | 4/1987 | Iwata . | |
| 4,733,324 | 3/1988 | George . | |
| 4,788,517 | 11/1988 | Meister . | |
| 4,837,539 | 6/1989 | Baker | 335/207 |
| 4,982,058 | 1/1991 | Schroeder et al. . | |
| 5,192,839 | 3/1993 | Imade et al. . | |
| 5,248,861 | 9/1993 | Kato et al. . | |
| 5,248,959 | 9/1993 | Chern . | |
| 5,332,992 | 7/1994 | Woods . | |
| 5,530,428 | 6/1996 | Woods . | |

*Primary Examiner*—Lincoln Donovan
*Attorney, Agent, or Firm*—Hovey, Williams, Timmons & Collins

[57] ABSTRACT

A magnetic switch assembly (100) for electrically coupling with an electrical circuit of an alarm system (16) and for detecting relative movement between a first, stationary member (102) and a second, moveable member (104) is disclosed. The switch assembly includes a switch means (106) adapted for mounting within the first stationary member and a corresponding electromagnet assembly (108) having an electromagnet (120). The switch means includes a housing (110), a pair of spaced switch elements (112,114) supported in the housing that are electrically coupled with an alarm device or system, a ferromagnetic body (116) such as a ball positioned within the housing and moveable between the switch elements, and a ferromagnetic core (118) positioned above or adjacent one of the switch elements for biasing the body to either its closed or opened position. The electromagnet (120) is coupled with a suitable source of electricity and is switchable between on and off states. When the electromagnet is on and the first and second members are generally adjacent one another, the electromagnet retains the body in its non-alarmed position against the bias of the ferromagnetic core. The electromagnet can be momentarily switched off when the first and second members are adjacent one another. This removes the magnetic force exerted by the electromagnet and therefore permits the body to move to its alarmed position for testing purposes.

16 Claims, 3 Drawing Sheets

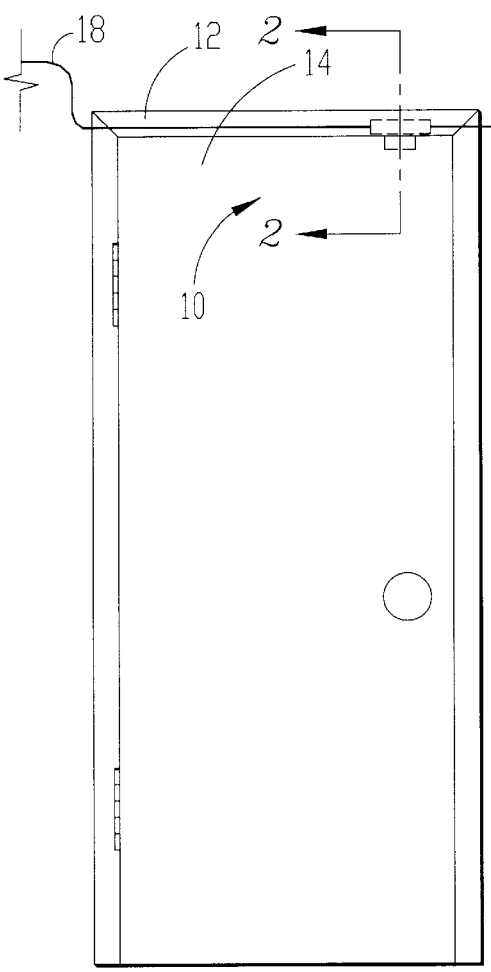
Fig. 1.
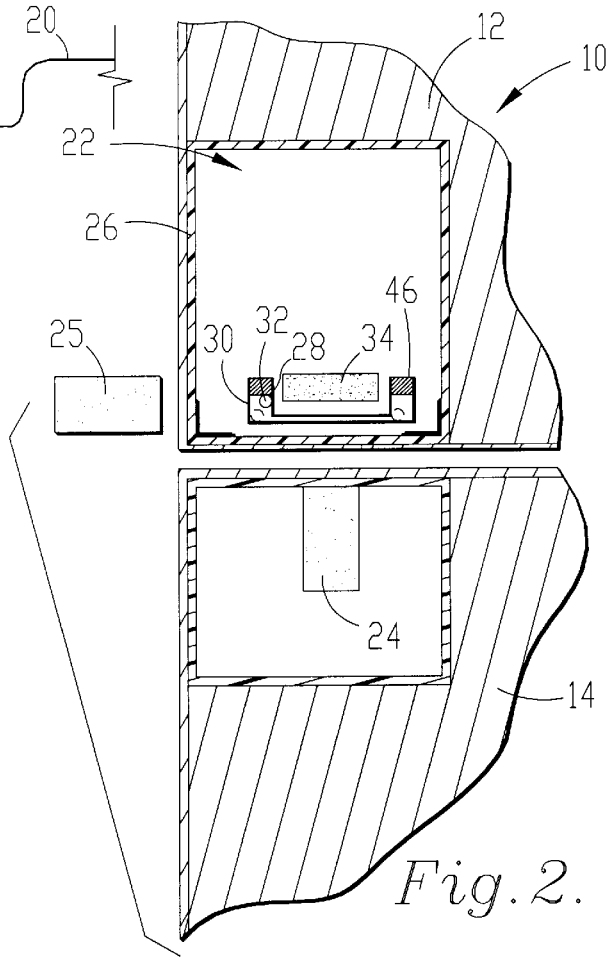
Fig. 2.
Fig. 3.
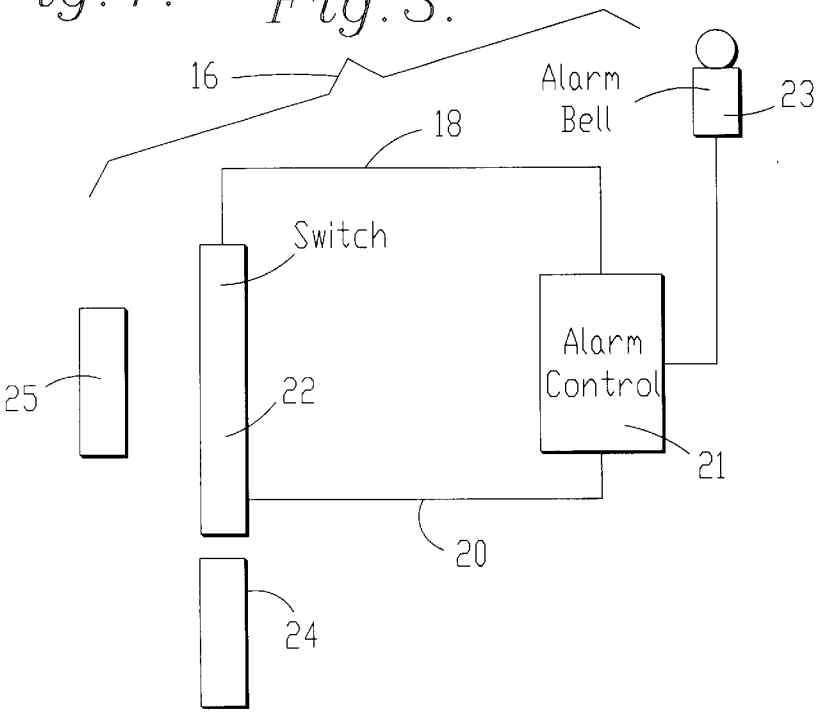

MAGNETIC SWITCH ASSEMBLY FOR DETECTING UNAUTHORIZED OPENING OF DOORS OR WINDOWS

BACKGROUND OF THE INVENTION

1. Field of the Invention

The present invention relates to magnetic switch assemblies for detecting unauthorized entry through doors or windows. More particularly, the invention relates to such a switch assembly that more effectively defeats magnetic manipulation by an intruder's magnet.

2. Description of the Prior Art

Magnetic switch assemblies for use with alarm systems are known in the art. One common switch assembly includes a magnetic reed switch mounted in a door or window frame and a magnet carried by the adjacent openable door or window. The magnet holds the reed switch in its opened or closed position (depending on whether the switch is of the normally opened or normally closed type) when the door or window is closed, and permits the reed switch to switch to its other position when the door or window is opened. The reed switch is typically interposed in an electrical circuit of an alarm system so that upon unauthorized opening of the door or window, the switch operation generates an alarm signal.

Unfortunately such reed-type switch assemblies can be readily defeated by simply placing an external magnet adjacent the door or window frame in proximity to the reed switch. The external magnet holds the reed switch in its non-alarm position and thus allows the door or window to be opened without triggering the alarm.

Improved magnetic switch assemblies have been developed to prevent such magnetic defeating of an alarm. For example, U.S. Pat. Nos. 5,332,992 and 5,530,428, hereby incorporated by reference, each disclose a magnetic switch assembly including a ball-type switch that is normally mounted in the door or window frame and magnet that is normally mounted in the corresponding door or window. The ball switch is held in one switch position by the door magnet and is shifted to the other switch position whenever the door is opened or when an intruder's magnet is placed in the vicinity of the switch assembly. This allows the switch to both detect the opening of the door or window and to prevent magnetic manipulation of the switch by an intruder's magnet.

Applicant has discovered that the switch assemblies disclosed in the '992 and '428 patents can be disarmed under certain circumstances. Specifically, when an alarm system is temporarily turned off to allow a person to pass through a door, the person could secure a thin magnet directly under the ball switch in the door frame to emulate the door magnet. The magnet would fit between the space between the door and frame and therefore be concealed from view.

Thereafter, when the alarm system is turned back on, the magnet will hold the ball switch in its non-alarmed position regardless of the position of the door. Thus, the intruder's magnet would permit the door to be opened without triggering the alarm.

An intruder could therefore enter a house or building under false pretenses during the day when the alarm system is off and disarm the switch assembly so that he or she could later return undetected. Those skilled in the art will appreciate that although low-security installations would not likely be subject to such sophisticated attempts of entry, high-security installations such as military, government and business buildings could be.

Prior art magnetic switch assemblies also cannot be tested from a central control center, but instead must be individually and manually tested by moving their associated doors or windows while their alarm systems are on to verify that the switches move to their alarmed states. Those skilled in the art will appreciate that such manual testing is time consuming, especially in large installations having many switch assemblies.

Another limitation of many prior art magnetic switch assemblies is that they must be formed with a sloped lower surface or include a small spring between the ball and one of the switch elements to bias or push the ball from its normally opened or closed position when the door or window is opened. Such biasing techniques increase the cost and complexity of switch assemblies and require more precise alignment of the switches in their door or window frame during installation. Moreover, such biasing techniques occasionally fail to bias a ball off its normally opened or closed position when its door is opened because of arc welds formed between the ball and one or both of the switch elements. Thus, prior art magnetic switches occasionally fail to detect the opening of the door or window and thus fail to trigger an alarm.

OBJECTS AND SUMMARY OF THE INVENTION

In view of the foregoing, it is an object of the present invention to provide an improved magnetic switch assembly.

More particularly, it is an object of the present invention to provide a magnetic switch assembly that more effectively resists magnetic manipulation by an intruder's magnet.

Still more particularly, it is an object of the present invention to provide a magnetic switch assembly that cannot be defeated by a magnet that is placed adjacent the switch when the switch's alarm system is turned off.

It is another object of the present invention to provide a magnetic switch assembly that can be tested from a central control center to verify that the switch is operational.

It is another object of the present invention to provide a magnetic switch assembly that does not require a sloped lower surface or spring to bias its ball away from its normally opened or closed position.

It is another object of the present invention to provide a magnetic switch assembly that achieves the above objectives while being simple and economical to construct and install.

The present invention achieves these objects and other objects that become evident from the following description of the present invention by providing an improved magnetic switch assembly that broadly includes a switch means adapted for mounting within a first, stationary member such as a door or window frame and a corresponding electromagnet for influencing the switching of the switch means. The switch means includes a housing, a pair of spaced switch elements supported in the housing that are electrically coupled with an alarm device or system, a ferromagnetic body such as a ball positioned within the housing and moveable between the switch elements, and a biasing means for biasing the movement of the ball.

The ferromagnetic body is moveable between a first, switch closed position wherein it is in simultaneous contact with both of the switch elements and a second, switch open position wherein the ball is in contact with only one of the switch elements. The biasing means, which is preferably a ferromagnetic core positioned above or adjacent one of the switch elements, biases the body to either its closed or opened position when the movable member is moved away from the stationary member.

The electromagnet, which is coupled with a suitable source of electricity, is switchable between on and off states and is positioned for exerting a magnetic force in the vicinity of the switch means. When the electromagnet is on and the first and second members are generally adjacent one another, the electromagnet retains the ferromagnetic body in its non-alarmed position (which may be either its open or closed position) against the bias of the biasing means. However, when the second member is moved relative to the first member, the magnetic force of the electromagnet is removed from the body so that the body moves to its alarmed position under the influence of the ferromagnetic core. Similarly, if an intruder attempts to apply an external magnet to the switch assembly to defeat the operation of the switch assembly, the magnetic field from the intruder's magnet overcomes the magnetic force exerted by the electromagnet and moves the ball to its alarmed position.

Advantageously, the electromagnet can be momentarily switched off when the first and second members are adjacent one another for testing purposes. This removes the magnetic force exerted by the electromagnet and therefore permits the ferromagnetic body to move under the bias of the ferromagnetic core to its alarmed position. The electromagnets of a plurality of switch assemblies can be wired to a central control area so that an operator can selectively test the operation of all the switch assemblies in this manner from a single location.

This construction also allows the operator to detect when a magnet has been placed under a switch means while its alarm is off. Specifically, if the operator switches off the electromagnet on a particular switch assembly and the ferromagnetic body in the switch assembly does not move to its alarmed position, the operator knows that the switch is under the influence of an intruder's magnet.

BRIEF DESCRIPTION OF THE DRAWING FIGURES

FIG. 1 is an elevational view of a hingedly mounted door protected by a switch assembly constructed in accordance with a preferred embodiment of the present invention, wherein the switch assembly is illustrated partially in phantom and is shown interposed within an alarm system;

FIG. 2 is an enlarged, fragmentary vertical sectional view taken along line 2—2 of FIG. 1 showing a door-mounted, normally closed switch assembly in accordance with a first embodiment of the invention and also illustrating attempted magnetic manipulation of the switch assembly by an external magnet;

FIG. 3 is a schematic representation of the switch assembly of the first embodiment of the invention shown interposed in a security alarm system;

DETAILED DESCRIPTION OF THE PREFERRED EMBODIMENTS

Figure 4:
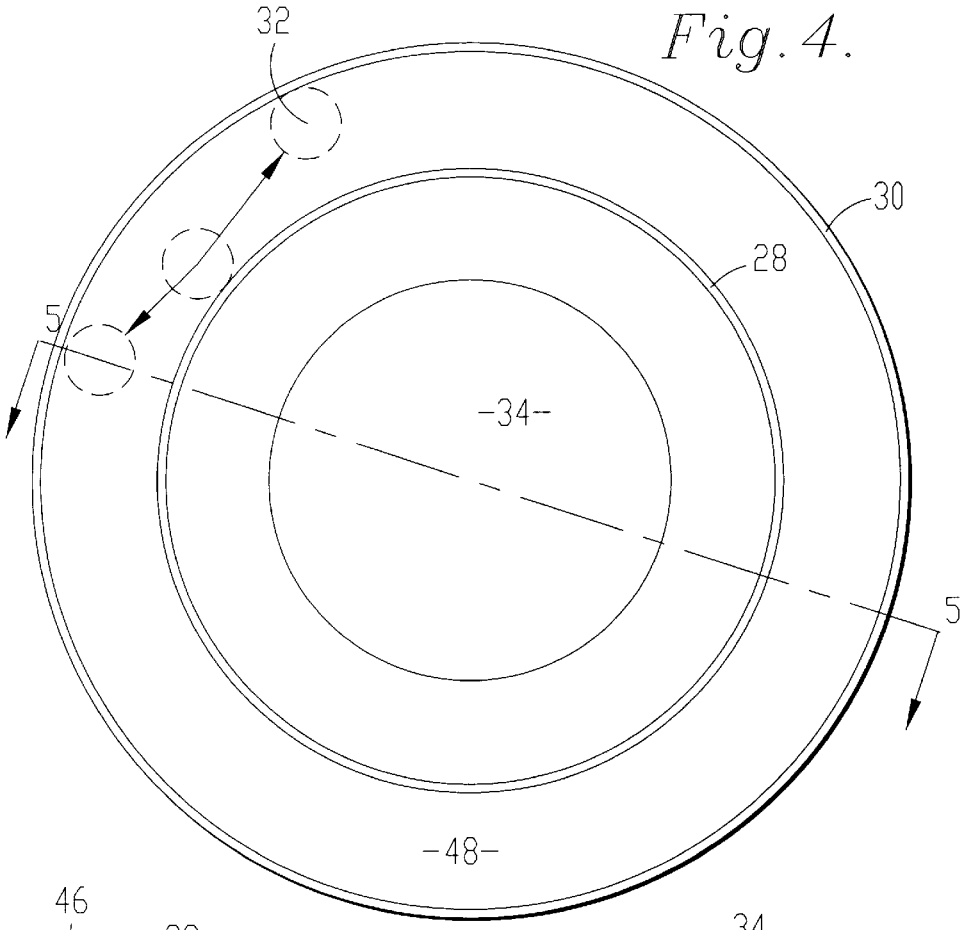
FIG. 4 is a top sectional view of the switch assembly of the first embodiment of the invention depicting a plurality of paths of travel for the ferromagnetic body.

FIGS. 1–2 illustrate a switch assembly 10 constructed in accordance with a first preferred embodiment of the invention. The switch assembly 10 is configured for detecting relative movement between a first, stationary member 12 such as a door or window frame and a second, moveable member 14 such as a door or window.

As illustrated in FIG. 3, the switch assembly 10 is preferably adapted for coupling with an alarm system 16 by a pair of electrical leads 18,20. The alarm system 16 is conventional and includes an alarm control assembly 21 and an alarm bell 23 or other perceptible alarm device. When the alarm system 16 is armed, any opening of the moveable member 14 or attempted magnetic manipulation of the switch assembly 10 by an intruder's magnet 25 will trigger an alarm signal as discussed in detail below.

The switch assembly 10 broadly includes switch means 22 adapted for mounting within the first, stationary member 12 and a corresponding actuator magnet 24 adapted for mounting within the second, movable member 14. As best illustrated in FIG. 2, the switch means 22 includes a housing 26, a pair of spaced upper and lower switch elements 28,30 supported in the housing, a ferromagnetic body 32 moveable between the switch elements, and a ferromagnetic core 34.

Figure 5:
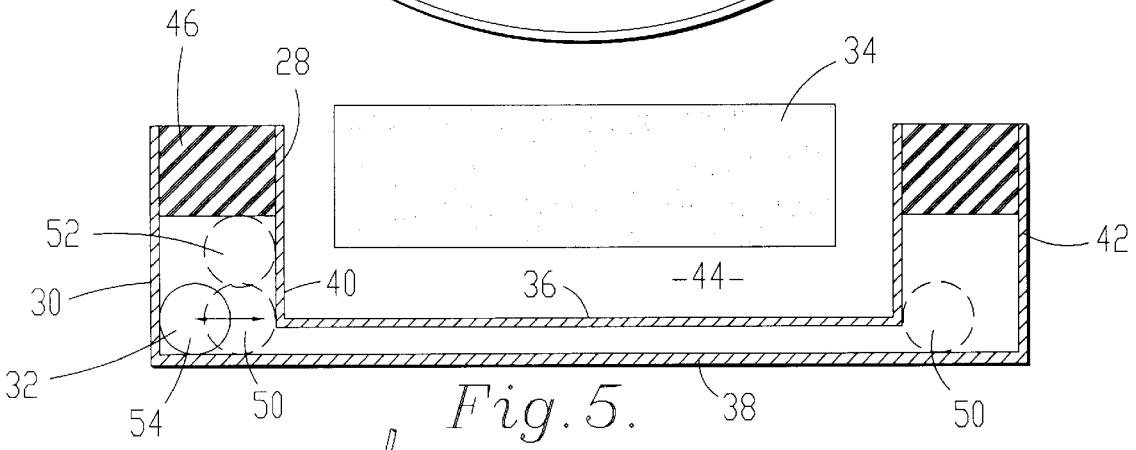
FIG. 5 is a vertical sectional view of the switch assembly taken along line 5—5 of FIG. 4.

The housing 26 is preferably formed of synthetic resin materials. The upper and lower switch elements 28,30 are preferably formed of non-magnetic metal and are each electrically coupled with one of the electrical leads 18,20. As best illustrated in FIG. 5, the switch elements 28,30 each includes a horizontally extending, circular bottom wall 36,38 and an upstanding, annular sidewall 40,42. The bottom wall 36 and sidewall 40 of the upper switch element 28 form an upper, open cylindrical well 44.

The switch elements 28,30 are spaced apart by a dielectric coupling ring 46 that holds the switch elements in a concentric relationship. The space between the periphery of the elements defines an open, annular raceway 48 best illustrated in FIG. 4 for accommodating movement of the ferromagnetic body 32. The coupling ring 46 may be formed of neoprene rubber, synthetic resin, or other non-conductive material.

The ferromagnetic body 32 is positioned between the switch elements 28,30 and is moveable to any position along the raceway 48. The ferromagnetic body is preferably a spherical ball made of permanent magnetic alloy material such as Alnico, but may also be formed in other shapes and manufactured of soft magnetic materials or other ferromagnetic materials. More than one body 32 can be installed in each switch means 22.

The body 32 is moveable between first, switch closed positions depicted by the numeral 50 in FIG. 5 wherein the body is in simultaneous contact with both the upper and lower switch elements 28,30 and second, switch opened positions depicted by the numbers 52,54 wherein the body is in contact with only one of the switch elements. The body 32 conducts electricity between the upper and lower switch elements 28,30 when it is positioned in any of its first, switch closed positions.

To increase the contact rating between the ferromagnetic body 32 and the switch elements 28,30 the body and the interior surfaces of the switch elements may be coated with mercury and the interior surfaces of the switch elements may be gold-plated.

The ferromagnetic core 34 is positioned within the cylindrical well 44 of the upper switch element 28. The core 34, which may be formed of either soft or hard magnetic materials, biases the ferromagnetic body 32 off of the lower switch element 30 to the second, switch opened position 52 depicted in FIG. 5. The ferromagnetic core 34 eliminates the need to form the switch assembly 10 with a sloped lower surface or spring.

Returning to FIG. 2, the actuator magnetic 24 is positioned within a housing 56 that is mounted within the top portion of the second, moveable member 14. The actuator magnet 24, which may also be formed of permanent or soft magnetic materials, is strategically oriented so that it influences the movement of the ferromagnetic body 32.

Specifically, when the first and second members 12,14 are adjacent one another, the actuator magnet 24 exerts a magnetic field upon the ferromagnetic body 32 that is greater than the magnetic force between the body and the ferromagnetic core 34. Thus, the actuator magnet 24 shifts and holds the ferromagnetic body 32 in one of its first, switch closed positions 50 depicted in FIG. 5 so that the body is in simultaneous contact with both of the switch elements 28,30.

However, when the second member 14 is moved away from the first member 12, the actuator magnet 24 no longer exerts a magnetic field upon the ferromagnetic body 32. This permits the magnetic force between the ferromagnetic body 32 and the ferromagnetic core 34 to lift the body off of the lower switch element 30 so that it is in the second, switch opened position 52 depicted in FIG. 5.

Similarly, when an intruder places a magnet 25 adjacent the switch assembly 10 in an attempt to manipulate the operation of the switch assembly, the intruder's magnet 25 overcomes the magnetic forces exerted by the actuator magnet 24 and the ferromagnetic core 34 and shifts the ferromagnetic body 32 to the switch opened position 54 depicted in FIG. 5. When the ferromagnetic body is shifted to one of its switch opened positions 52,54, it opens a contact or relay in the alarm control 21 of the alarm system 21 to trigger an alarm signal.

Figure 6:
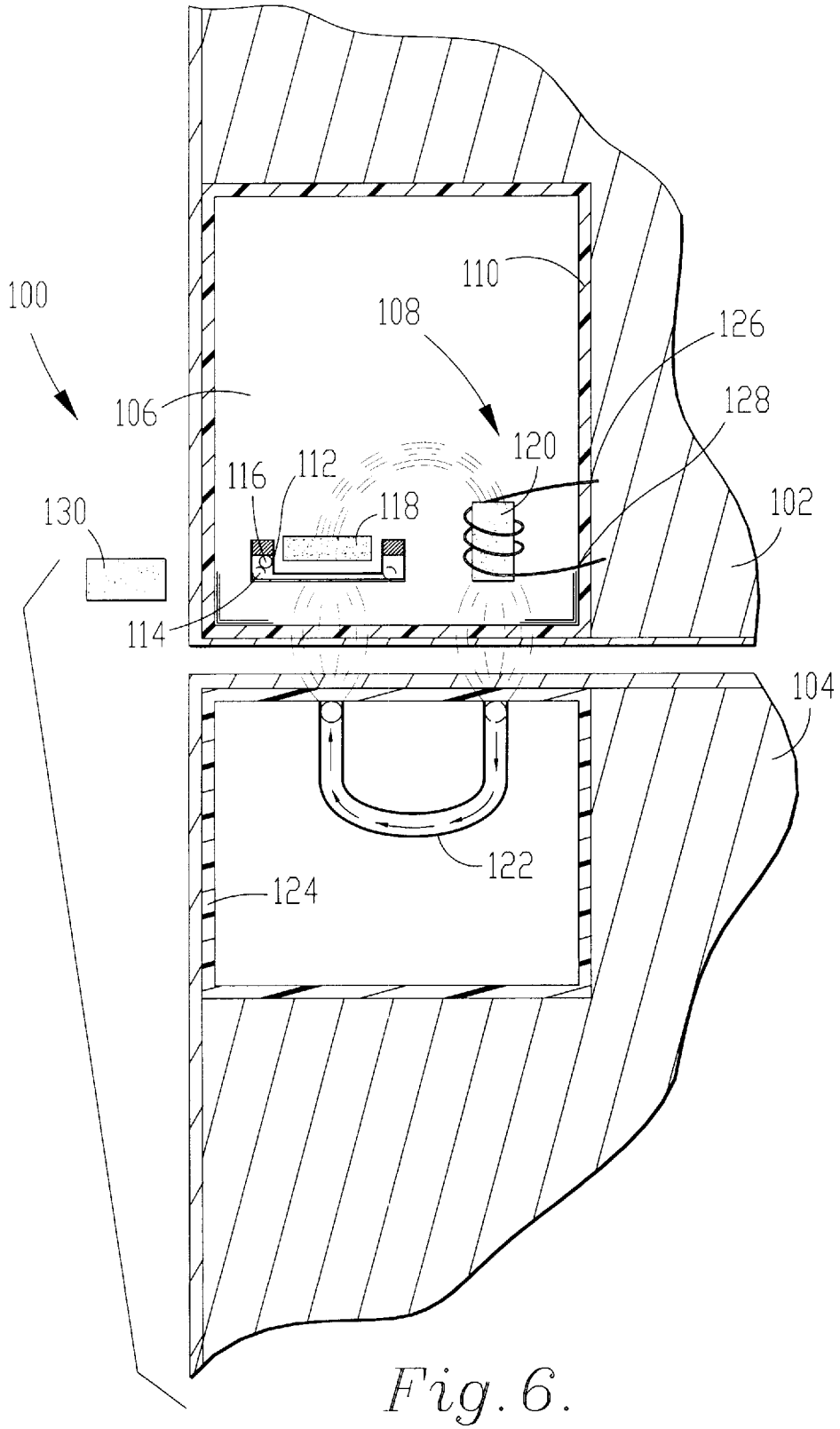
FIG. 6 is an enlarged, fragmentary vertical sectional view of a switch assembly constructed in accordance with a second embodiment of the invention.

FIG. 6 illustrates a switch assembly 100 constructed in accordance with a second preferred embodiment of the invention and configured for detecting relative movement between a first, stationary member 102 and a second, moveable member 104. The switch assembly 100 broadly includes a switch means 106 adapted for mounting within the first, stationary member 102 and a corresponding electromagnet assembly 108 for influencing the switching of the switch means.

The switch means 106 is substantially identical to the switch means 22 of the first embodiment of the invention and includes a housing 110, a pair of spaced upper and lower switch elements 112,114 supported in the housing, a ferromagnetic body 116 positioned within the housing and moveable between the switch elements, and a ferromagnetic core 118 for biasing the movement of the ball.

The electromagnet assembly 108 preferably includes an electromagnet 120 mounted in or near the housing of the switch means 106 adjacent the switch elements 112,114 and a horseshoe-shaped magnet shunt 122 mounted in a housing 124 positioned in the second, moveable member 104.

The electromagnet 120 is coupled with a suitable source of electricity by a pair of electrical leads 126,128 and is switchable between on and off states. The electromagnet is oriented in a vertical or North/South configuration so that when it is on, its magnetic flux passes through the magnet shunt 122 and the switch means 106.

The electromagnet 120 may also be mounted within the second, moveable member 104. Although this would eliminate the need for the magnet shunt 122, it would require that the electrical leads 126,128 be routed to the moveable member 104. Therefore, this mounting arrangement is not preferred.

In operation of the switch assembly 100, the electromagnet 120 shifts and retains the ferromagnetic body 116 in one of its first, switch closed positions against the bias of the ferromagnetic core 118 when the electromagnet is on and the first and second members 102,104 are generally adjacent one another. However, when the second member 104 is opened, the magnetic force of the electromagnet 120 is removed from the body 116 so that the body moves to its second, switch opened position under the influence of the ferromagnetic core 118.

Similarly, if an intruder attempts to apply an external magnet 130 adjacent the stationary member 102 to defeat the operation of the switch assembly 100, the magnetic field from the intruder's magnet 130 overcomes the magnetic force exerted by the electromagnet 120 and moves the body 116 to one of its second, switch opened positions.

Advantageously, the electromagnet 120 can be momentarily switched off when the first and second members 102,104 are adjacent one another for testing purposes. This removes the magnetic force exerted by the electromagnet 120 and therefore permits the ferromagnetic body 116 to move under the bias of the ferromagnetic core 118 to its alarmed, second, switch opened position. The electromagnets 120 of a plurality of switch assemblies 100 can be wired to a central control area so that an operator can selectively test the operation of all the switch assemblies from a single location in this manner without manually moving the moveable members to which the switch assemblies 100 are coupled.

This construction also allows the operator to detect when a magnet is placed under the switch means 106 while its associated alarm is off. Specifically, if the operator switches off the electromagnet 120 on a particular switch assembly 100 and the ferromagnetic body 116 in the switch assembly does not move to its alarmed, opened position, the operator knows that the switch is under the influence of an intruder's magnet.

Figure 7:
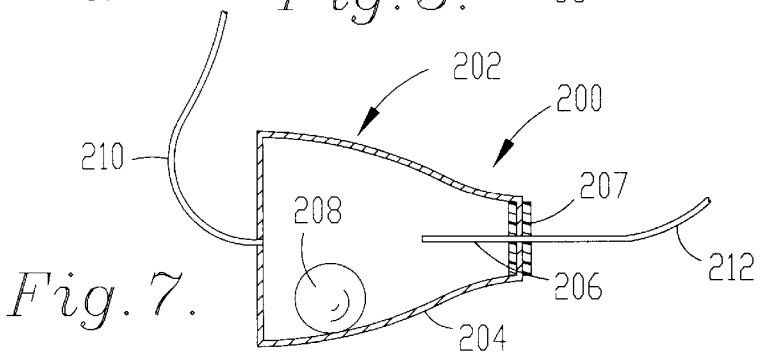
FIG. 7 is a vertical sectional view of a switch assembly constructed in accordance with a third embodiment of the invention.

FIG. 7 illustrates a switch assembly 200 constructed in accordance with a third embodiment of the invention. The switch assembly 200 includes a switch means 202 adapted for mounting in a first, stationary member and an actuator magnet (not shown) for mounting in a corresponding, second moveable member.

The switch means 202 includes a metallic, electrically conductive housing 204, an electrically conductive pin 206 that extends from the base of the housing, an insulator 207 between the housing 204 and pin 206, and a shiftable, electrically-conductive ball 208 positioned for movement within the housing 204. The ball 208 is formed of ferromagnetic material. The housing 204 and pin 206 are preferably constructed of non-magnetic materials so that they do not interfere with the magnetic effect exerted on the ball 208.

The housing 204 is coupled with a first electrical lead 210 connected to an alarm system such as the one illustrated in FIG. 3 and acts as a first switch element. The pin 206 is coupled with a second electrical lead 212 and acts as a second switch element. Advantageously, the housing 204 is formed with a sloped sidewall that biases the ball 208 off the conductive pin 206. This permits the switch assembly 200 to be oriented in nearly any position yet remain in a normally opened position.

The ball 208 is movable within the housing 204 between a switch closed position wherein it contacts both the housing 204 and the pin 206 and a switch open position illustrated in FIG. 7 wherein it is spaced from the pin.

The actuator magnet exerts a magnetic field in the vicinity of the switch means 202 that shifts the ball 208 to its first, switch closed position when the first and second members are adjacent one another. However, when the second member is moved away from the first member, the magnetic field from the actuator magnet is removed from the switch means 202 so that the sloped surface of the housing moves the ball 208 to its second, switch opened position.

Similarly, if an intruder attempts to defeat the operation of the switch assembly 200 by applying an external magnet near the switch assembly, the magnetic field of the intruder's magnet overcomes the magnetic field of the actuator magnet, causing the ball 208 to move away from the pin 206. This switches the switch means 202 to its open position, thus changing the state of the electrical circuit of the alarm system for triggering an alarm.

Although the invention has been described with reference to the preferred embodiment illustrated in the attached drawing figures, it is noted that equivalents may be employed and substitutions made herein without departing from the scope of the invention as recited in the claims. For example, although the switch assemblies 10,100,200 are preferably used with alarm systems, they may also be used in other applications to detect relative movement between two members. For example, the switch assemblies may be coupled with a float to operate a pump based on the position of the float or may be coupled with a door in an automobile for switching the interior lights of the automobile.

Having thus described the preferred embodiment of the invention, what is claimed as new and desired to be protected by Letters Patent includes the following:

1. A switch assembly for electrically coupling with an electrical circuit of an alarm system for detecting relative movement between first and second members, said switch assembly comprising:

switch means for mounting on one of the members, said switch means including:

housing, a pair of spaced switch elements supported in said housing, a ferromagnetic body positioned within said housing and moveable between a first switch closed position wherein said body is in simultaneous contact with said switch elements and a second switch open position wherein said body is in contact with only one of said switch elements, and biasing means for biasing said body to one of said first and second positions upon relative movement between the first and second members; and an electromagnet for mounting on the other of the members and switchable between on and off states, said electromagnet being oriented for: retaining said body in the other of said first and second positions against thebias of said biasing means when the first and second members are generally adjacent one another and said electromagnet is switched on, and permitting said body to be biased to said one of said first and second positions by said ferromagnetic body when said electromagnet is switched off for permitting testing of said switch assembly.

2. The switch assembly as set forth in claim 1, said biasing means including a ferromagnetic core positioned adjacent one of said switch elements and oriented for biasing said body to said one of said first and second positions upon relative movement between the first and second members.

3. The switch assembly as set forth in claim 2, said switch means and said electromagnet being configured for mounting on the first member, said switch assembly further including a magnetic shunt for mounting on the second member and configured for directing the magnetic force of said electromagnet toward said switch means.

4. The switch assembly as set forth in claim 3, the first member being a door frame and the second member being a hingedly mounted door moveable relative to the door frame.

5. The switch assembly as set forth in claim 1, said ferromagnetic body being formed from permanent magnetic materials.

6. The switch assembly as set forth in claim 1, said ferromagnetic body being formed from soft magnetic materials.

7. The switch assembly as set forth in claim 2, said ferromagnetic core being formed from permanent magnetic materials.

8. The switch assembly as set forth in claim 2, said ferromagnetic core being formed from soft magnetic materials.

9. A switch assembly for electrically coupling with an electrical circuit of an alarm system for detecting relative movement between first and second members, said switch assembly comprising:

a switch assembly for mounting on one of the members, the switch assembly including:

housing, a pair of spaced switch elements supported in said housing, a ferromagnetic body positioned within said housing and moveable between a first switch closed position wherein said body is in simultaneous contact with said switch elements and a second switch open position wherein said body is in contact with only one of said switch elements, and a ferromagnetic core positioned adjacent one of said switch elements and oriented for biasing said body to one of said first and second positions upon relative movement between the first and second members; and an actuator magnet for mounting on one of the first and second members and oriented for retaining said body against the bias of said ferromagnetic core in the other of said first and second positions when the first and second members are generally adjacent one another.

10. The switch assembly as set forth in claim 9, said actuator magnet comprising an electromagnet switchable between on and off states and oriented for:

retaining said ferromagnetic body in the other of said first and second positions against the bias of said biasing means when the first and second members are generally adjacent one another and the electromagnet is on, and permitting said body to be biased to said one of said first and second positions by said ferromagnetic body when the electromagnet is off for permitting testing of said switch assembly.

11. The switch assembly as set forth in claim 10, said switch means and said electromagnet being configured for mounting on the first member, said switch assembly further including a magnetic shunt for mounting on the second member and configured for directing the magnetic force of said electromagnet toward said switch means.

12. The switch assembly as set forth in claim 9, the first member being a door frame and the second member being a hingedly mounted door moveable relative to the door frame.

13. The switch assembly as set forth in claim 9, said ferromagnetic body being formed from permanent magnetic materials.

14. The switch assembly as set forth in claim 9, said ferromagnetic body being formed from soft magnetic materials.

15. The switch assembly as set forth in claim 9, said ferromagnetic core being formed from permanent magnetic materials.

16. The switch assembly as set forth in claim 9, said ferromagnetic core being formed from soft magnetic materials.

* * * * *